US005587282A

United States Patent [19]

Nakatsugawa et al.

[11] Patent Number: 5,587,282

[45] Date of Patent: Dec. 24, 1996

[54] SILVER HALIDE PHOTOGRAPHIC MATERIAL

[75] Inventors: Haruyasu Nakatsugawa; Masakazu Yoneyama; Shigeharu Urabe, all of Kanagawa, Japan

[73] Assignee: Fuji Photo Film Co., Ltd., Minami-ashigara, Japan

[21] Appl. No.: 504,348

[22] Filed: Jul. 19, 1995

[30] Foreign Application Priority Data

Jul. 28, 1994 [JP] Japan ..... 6-177183

[51] Int. Cl.[6] ..... G03C 1/043

[52] U.S. Cl. ..... 430/637; 430/569; 430/627

[58] Field of Search ..... 430/637, 567, 430/569, 627

[56] References Cited

U.S. PATENT DOCUMENTS 4,004,927 1/1977 Yamamoto et al. ..... 430/523

FOREIGN PATENT DOCUMENTS

0063349A1 10/1982 European Pat. Off. .

*Primary Examiner*—Hoa Van Le

*Attorney, Agent, or Firm*—Burns, Doane, Swecker & Mathis, LLP

[57] ABSTRACT

Disclosed is a silver halide photographic material comprising a support having thereon at least one light-sensitive silver halide emulsion layer, wherein the silver halide emulsion is produced in the presence of a polyalkylene oxide group-containing organopolysiloxane. The emulsion being produced in the presence of the defoaming agent is prevented from being foamed in a stirrer rotating at an elevated rotation speed. The stirring performance of the stirrer is enlarged, and the conditions for forming the silver halide grains can be controlled more uniformly. The photographic properties of the emulsion are improved and it is easy to scale up the production of the emulsion.

3 Claims, No Drawings

SILVER HALIDE PHOTOGRAPHIC MATERIAL

FIELD OF THE INVENTION

The present invention relates to a silver halide photographic material and, in particular, to a silver halide photographic emulsion which is produced uniformly in a large amount with being foamed little.

BACKGROUND OF THE INVENTION

To produce a silver halide photographic material, in general, an aqueous solution of a silver salt, for example an aqueous solution of silver nitrate, and a solution of water-soluble halide which are a reacting agent (substance) are added to an aqueous solution of colloid, for example an aqueous solution containing gelatin to make silver halide grains precipitated therein. As means of adding these reacting agents to the aqueous solution of colloid, for example, a single jet method and a double jet method are widely known. Such reaction means are disclosed, for example, by Pierre Glafkides in Photographic Chemistry (published by Fountain Press, London, 1958), pp. 327 to 330, and by T. H. James in The Theory of the Photographic Process, Vol. 4, pp. 88 to 104.

The photographic properties of the silver halides to be produced according to the above-mentioned methods for producing photographic emulsions are determined essentially depending on the stirring condition for precipitating or physically ripening the grains. The performance of the stirrer to be used for such purposes, including, for example, the bulk mixing time (this is defined as the time necessary for mixing the aqueous solution of silver nitrate that has been pulse-wise added to a reactor with the aqueous solution of colloid until the plural silver electrodes provided in the reactor become uniform), the critical growth speed (this is defined as the maximum addition speed at which silver halide grains are grown in the presence of seed crystals without forming any new nucleus), etc. is determined substantially by the flow rate to be jetted out from the stirrer. The flow rate is defined as the amount of the flow to be discharged from the stirrer within one minute by the action of the stirring blades in the stirrer. The flow rate (Q) to be jetted out from a stirrer (i.e., the delivery rate) is generally represented by:

$$Q \sim Nd^3$$

(i.e., $Q=N_Q Nd^3$ wherein $N_Q$ means a delivery coefficient) wherein N means the stirring rotation number of the blades in the stirrer, and d means the diameter of each blade therein. Therefore, the flow rate is proportional to the stirring rotation number of the blades in a stirrer. This is described in, for example, Practice in Stirring Technology (edited by the Association for Technology Information of Japan, 1989), page 42.

Further, the above relation is in detail described in N. Harnby, M. F. Edwards, A. W. Nienon, *Mixing in the Process Industries.*

Therefore, in order to improve the general performance of a stirrer, it is necessary to rotate the stirring blades therein at high speed when the diameter of each stirring blade therein is defined to a constant value. Being different from a side-arm-type closed stirrer such as that described in JP-B-48-21045 (the term "JP-B" as referred to herein means an "examined Japanese patent publication"), a submerging type stirrer having a large opening area naturally has a small stirring rotation number (about several hundreds to 3000 rpm or so) because of the problem of foaming and, therefore, even the slight increase in the stirring rotation number results in a noticeable increase in the performance of the stirrer itself. For these reasons, it is desired that such a submerging type stirrer is stirred at the greatest possible speed.

If the stirring rotation number of an axial-flow-type stirrer that generates a flow in the direction parallel to the stirring axis, such as that described in JP-B-35-10545, is increased so as to enhance its mixing performance, the stirrer thereby generates a V-cut flow due to the enlarged horizontal rotation flow. The V-cut flow is caused by the centrifugal force of the horizontal rotation flow that makes the liquid in the stirrer pushed toward the side wall of the stirrer, on the contrary, making the level of the liquid near the stirring axis depressed to have a V-cut shape. The V-cut flow causes foaming of the liquid being stirred, since it takes air in itself while it runs from the side wall of the container to the stirring axis.

If the stirring rotation number of a radial-flow-type stirrer that generates a flow in the radial direction perpendicular to the stirring axis, such as that described in JP-B-49-48964, is increased so as to enhance its mixing performance, the stirrer thereby generates a mountain-like flow that expands near the side wall of the stirrer. Such a mountain-like flow also causes foaming of the liquid being stirred, since it takes air in itself while it runs from the side wall of the stirrer to the center thereof.

The foaming of the liquid being stirred, that is caused by the increase in the stirring rotation of such a stirrer, often involves various problems in that the liquid gives coarse grains thereby broadening the grain size distribution of the silver halide grains formed, that the critical growth speed of the silver halide grains being formed is lowered, that the photographic properties of the grains formed are worsened (for example, the emulsion comprising the grains is easily fogged or the contrast of the emulsion is lowered), and that the stability and the efficiency in producing the grains are lowered. In particular, the foaming in question is especially problematic in a so-called controlled double jet method for producing a silver halide emulsion while controlling the silver potential of the emulsion, which is most popularly employed in this technical field in these days, in that the foams generated in the emulsion adhere to the silver electrode thereby making it impossible to accurately measure the silver potential of the emulsion being formed and making it difficult or impossible to control the silver potential. The pollution of various sensors such as the silver electrode, etc. by the foams generated is noticeable also during the step of desalting the emulsion formed. To remove the problems to be caused by the foaming, generally employed are a means of adding a coagulant-to the liquid being stirred in a stirrer by which a part of the coagulated solids (grains having a small specific gravity or small grains) is made floated on the surface of the liquid without being precipitated, and a means of submerging a drain duct having a strainer at its tip in the supernatant formed over the liquid being stirred, through which the supernatant is removed by means of a pump. According to these means, however, the strainer used is clogged by the coagulated solids floating over the liquid along with the foams.

To overcome the above-mentioned problems, there is known defoaming technology such as physical and mechanical defoaming and chemical defoaming in terms of the practical performance. If the former physical and mechanical defoaming means is applied to the axial-flow-type stirrer that is often troubled by the foaming mechanism mentioned above, the stirrer must be so reconstructed that it may inhibit the horizontal rotation flow. If, on the other hand, it is applied to the radial-flow-type stirrer, the stirrer must be so reconstructed that it may inhibit the mountain-like flow near the side wall of the stirrer. Thus, the physical and mechanical defoaming means requires the reconstruction of the stirrer, depending on the type of the stirrer to which it is applied. For instance, a conventional physical and mechanical defoaming means applied to an axial-flow-type stirrer has been proposed in JP-B-57-92524 and Japanese Utility Model Publication No. 62-16183, in which a flow-controlling plate is fixed horizontally at the top of the stirrer by which the horizontal rotation flow generated is converted into a perpendicular flow thereby inhibiting the generation of the V-cut flow. On the other hand, a conventional physical and mechanical defoaming means applied to a radial-flow-type stirrer has been proposed in Japanese Patent Application No. 6-11675, in which a dimple structure or a projection structure having many dimples or projections is disposed on at least a part of the inside wall of the stirrer or in at least a part of the internal space of the stirrer. Both of these conventional physical and mechanical defoaming means are effective in terms of only the foam-inhibiting object but are still defective in terms of the object of rapidly extinguishing the foams (that is, the object of shortening the time necessary for extinguishing the foams) when the stirring of the liquid in the stirrer is stopped. The drawback of the means having such a poor ability to rapidly extinguish the foams is still problematic, as worsening the production stability and efficiency.

Various chemical defoaming means of using defoaming agents have heretofore been known in various industrial fields. As such defoaming agents, in general, used are silicone emulsions, sorbitan fatty acid esters, higher alcohols, animal and vegetable oils, mineral oils (e.g., paraffin, etc.), polyoxyalkylene glycol derivatives, etc. Examples of these are described in Practice in Stirring Technology (edited by the Association for Technology Information of Japan, 1989), page 121.

Various defoaming agents such as those mentioned below are used in the production of emulsions of silver halide grains.

In U.S. Pat. No. 5,147,771, European Patent 513,723A, U.S. Pat. Nos. 5,147,772 and 5,147,773, there is disclosed the use of polyethylene oxide block copolymers to obtain good monodispersed emulsions. Of the disclosed copolymers, those having a propylene oxide content (PO) of 80% or more are effective as the intended defoaming agent. As commercial products, effective are Pururonic 31R1, 25R2, 17R2, L101 and L61 (all products of BASF), and Tetronic 1301, 901, 130R1 and 110R1 (all products of BASF).

In JP-B-44-9497, JP-B-44-26580, JP-A-59-188640, JP-A-59-189339, JP-A-62-231246 (the term "JP-A" as used herein means an "unexamined published Japanese patent application"), described are various defoaming agents such as copolymers of polypropylene oxide (PPO) and polyethylene oxide (PEO) having a PPO content falling within a defined range, water-soluble alkaline earth metals, lower alcohols, etc.

Copolymers of PPO and acrylamide having a PPO content of 70% or more and mixtures of side-chained PPO homopolymer(s) and side chained PEO homopolymer(s) having a PPO content of 70% or more, such as those described in JP-A-7-98482 and EP063349A1 (corresponding to JP-A-7-28183) are effective as the defoaming agent intended herein.

When the above-mentioned defoaming agents are used, in general, attentions shall be paid to the following matters. Alcohols such as 2-ethylhexyl alcohol, octyl alcohol, etc. exhibit the defoaming effect only when they have just added to a liquid to be defoamed. However, their defoaming effect is insufficient if a relatively large amount of them is not added. In the factory where photographic materials are produced generally in a closed system, it is difficult to treat vaporized alcohols. In addition, the foam-inhibiting effect of the alcohols is not good. Silicone oils exhibit an excellent defoaming effect. However, when emulsions containing such a silicone oil are coated on supports, the supports often repel the emulsions due to the silicone oil contained therein whereby the quality of the coated supports (photographic materials) is often lowered. Therefore, special attention shall be paid to the handling of silicone oils. There is a probability that alkylene oxide copolymers are often deteriorated in the photographic properties of silver halide photographic emulsions. Therefore, special attention shall be paid to the amount of the copolymers, if used. In particular, the amount of the copolymer to be used for defoaming surfactants having a large HLB value (hydrophobic/hydrophilic balance) is about 10 times the amount thereof to be used for defoaming proteins such as gelatin, etc. If such a large amount of the copolymer is added to a photographic emulsion, it causes competing adsorption against the sensitizers to be in the emulsion while having in no small way some negative influences on the photographic properties of the emulsion to lower the sensitivity of the emulsion or to increase its fog. The above-mentioned commercial products, Pururonic have some negative influences on the formation of silver halide grains, depending on the condition for the formation. For example, if Pururonic TM31R1 is used for the formation of tabular silver iodobromide grains, it makes the grains thick thereby lowering the aspect ratio of the grains. In addition, it is adsorbed to the (100) face of the grains to retard the growth of the grains. Moreover, it depends on pH values. As mentioned hereinabove, there are various problems when the conventional defoaming agents are applied to the formation of silver halide grains to be in photographic emulsions.

SUMMARY OF THE INVENTION

One object of the present invention is to produce a photographic emulsion, while inhibiting the foaming of the emulsion being stirred at an increased stirring rotation number with the use of a defoaming agent that is free from the above-mentioned problems. Using the defoaming agent, therefore, the stirring performance of the stirrer to be used for producing the emulsion can be enhanced. Another object of the present invention is to accelerate the speed at which an aqueous solution of silver nitrate is added to produce a photographic emulsion, whereby the costs for producing the emulsion is lowered. Still another object of the present invention is to control more uniformly the conditions for forming the silver halide grains to be in a photographic emulsion thereby improving the photographic properties of photographic material using the emulsion and scaling up the capability for producing the emulsion. The final object of the present invention is to provide a silver halide photographic material containing the emulsion thus produced efficiently by the use of the specifically-selected defoaming agent.

These objects of the present invention have been attained by a silver halide photographic material comprising at least one light-sensitive silver halide emulsion that has been produced in the presence of a polyalkylene oxide group-containing organopolysiloxane.

DETAILED DESCRIPTION OF THE INVENTION

The polyalkylene oxide group-containing organopolysiloxane to be used in the present invention is not specifically defined. The organopolysiloxane compound is described in more detail hereinunder. The examples of the polyalkylene oxide groups include, for example, polyethylene oxide, polypropylene oxide, polybutylene oxide, polystyrene oxide, and combinations of these. The organopolysiloxane moiety is, for example, a polysiloxane comprising units each composed of organic groups, such as alkyl and phenyl groups having from 1 to 18 carbon atoms, bonded to a silicon atom or is a combination of such polysiloxanes.

It is desirable that the organopolysiloxane compound to be used in the present invention is sparingly soluble in water or dispersible in water. Especially preferably, the compound is a linear polysiloxane having at least one polyalkylene oxide group-containing siloxane unit represented by formula (I) or (II):

$$-\underset{\underset{(CH_2)_a(OC_2H_4)_b(OC_3H_6)_cOR}{|}}{\overset{\overset{CH_3}{|}}{Si}}O- \quad \text{(I)}$$

-continued $$-\underset{\underset{CH_3}{|}}{\overset{\overset{CH_3}{|}}{Si}}O-(CH_2)_a(OC_2H_4)_b(OC_3H_6)_cOR \quad \text{(II)}$$

In these formulae (I) and (II), R represents a hydrogen atom or a monovalent group such as an alkyl group, a phenyl group or the like; a represents from 2 to 12; b and c each represent a number of from 1 to 50, provided that both b and c must not be 0 (zero) at the same time.

Specific examples of the organopolysiloxane compound to be used in the present invention are represented by formulae (III) to (VI), which, however, are not limitative. In these formulae, X represents an alkyl group; and R' represents a hydrogen atom or an alkyl group. By varying the values of l, m, n, a, b and c in these formulae, the hydrophobic/hydrophilic balance of the compounds can be varied. In general, these compounds often lose their defoaming ability but are to exhibit foaming ability (i.e., frothing ability) when their hydrophilic property is too strong. Therefore, it is important that the values l, m, n, a, b and c are suitably controlled so that the compounds may be sparingly soluble in water or dispersible in water.

$$(CH_3)_3SiO\left(\underset{\underset{CH_3}{|}}{\overset{\overset{CH_3}{|}}{Si}}O\right)_l\left(\underset{\underset{(CH_2)_a-(OC_2H_4)_b(OC_3H_6)_cOR}{|}}{\overset{\overset{CH_3}{|}}{Si}}O\right)_m\left(\underset{\underset{X}{|}}{\overset{\overset{CH_3}{|}}{Si}}O\right)_n Si(CH_3)_3 \quad \text{(III)}$$

| | l | m | n | a | b | c | X | R | Addition Type of Alkylene Oxide |
|---|---|---|---|---|---|---|---|---|---|
| S-1 | 10 | 5 | 0 | 3 | 0 | 10 | $CH_3$ | $CH_3$ | |
| -2 | 20 | 3 | 0 | 3 | 4 | 0 | $CH_3$ | H | |
| -3 | 27 | 3 | 0 | 3 | 4 | 0 | $CH_3$ | $C_4H_9$ | |
| -4 | 24 | 4 | 0 | 3 | 10 | 0 | $CH_3$ | $C_4H_9$ | |
| -5 | 24 | 4 | 0 | 3 | 14 | 28 | $CH_3$ | H | Block |
| -6 | 24 | 4 | 0 | 3 | 14 | 30 | $CH_3$ | $C_4H_9$ | Random |
| -7 | 24 | 4 | 0 | 3 | 18 | 50 | $CH_3$ | H | Block |
| -8 | 24 | 4 | 0 | 3 | 23 | 50 | $CH_3$ | H | Random |
| -9 | 27 | 5 | 0 | 3 | 19 | 25 | $CH_3$ | H | Block |
| -10 | 27 | 5 | 0 | 3 | 14 | 20 | $CH_3$ | H | Random |
| -11 | 20 | 2 | 4 | 2 | 5 | 0 | n-$C_5H_{11}$ | H | |
| -12 | 20 | 2 | 4 | 3 | 12 | 10 | $CH_2CH(CH_3)-C_6H_5$ | $CH_3$ | Block |

$$RO(C_3H_6O)_c(C_2H_4O)_b(CH_2)_a-\left(\underset{\underset{CH_3}{|}}{\overset{\overset{CH_3}{|}}{Si}}O\right)_l\underset{\underset{CH_3}{|}}{\overset{\overset{CH_3}{|}}{Si}}-(CH_2)_a(OC_2H_4)_b(OC_3H_6)_cOR \quad \text{(IV)}$$

| | l | a | b | c | R |
|---|---|---|---|---|---|
| S-13 | 20 | 3 | 3 | 0 | H |
| -14 | 20 | 3 | 2 | 20 | $C_4H_9$ |
| -15 | 24 | 3 | 12 | 15 | H |
| -16 | 24 | 3 | 16 | 28 | $CH_3$ |
| -17 | 24 | 3 | 12 | 28 | $CH_3$ |

-continued

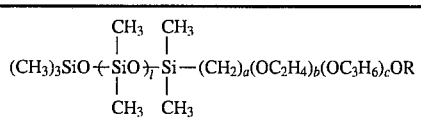

(V)

| | l | a | b | c | R | Addition Type of Alkylene Oxides |
|---|---|---|---|---|---|---|
| S-18 | 20 | 3 | 10 | 20 | $C_4H_9$ | Block |
| -19 | 20 | 3 | 5 | 0 | $C_{12}H_{25}$ | |
| -20 | 10 | 3 | 7 | 0 | $C_{18}H_{37}$ | |
| -21 | 20 | 3 | 24 | 30 | $CH_3$ | Block |

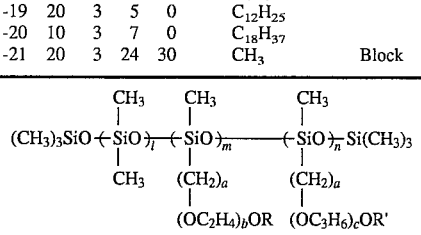

(VI)

| | l | m | n | a | b | c | R | R' |
|---|---|---|---|---|---|---|---|---|
| S-22 | 24 | 3 | 3 | 3 | 14 | 28 | $CH_3$ | $CH_3$ |
| -23 | 27 | 4 | 4 | 3 | 10 | 16 | $C_4H_9$ | $C_4H_9$ |
| -24 | 20 | 1 | 1 | 3 | 10 | 17 | H | H |

The compounds to be used in the present invention can be easily synthesized, for example, by reacting an organopolysiloxane having a SiH group with allyl alcohol having an alkylene oxide added thereto in the presence of a platinum catalyst. The addition of alkylene oxides to the polymer may be conducted either by block polymerization or random polymerization. For the block polymerization, the order of the blocks in the polymer is not specifically defined. Various commercial products of such organopolysiloxane compounds are known, including, for example, Silicone L77, 720, 722, 7001, 7602, 7604, 7605, 7607N, Silicone FZ2104, 2110, 2120, 2161, 2162, 2163, 2164, 2165, 2166, 2171, Silicone F178-03, 178-05, 178-09, 178-21, 178-28 (all products of Nippon Unichika Co.), and X-22-3939A, X-22-3667, X-22-904 and X-22-4272 (all products of Shin-etsu Chemical Co.).

The amount of the defoaming agent to be used in the production of silver halide emulsions shall be strictly determined, depending on the amount of the liquid in the reactor, the amount and the kind of-the dispersion medium used, the stirring rotation number, the shape of the reactor, the temperature, the type of the stirrer used, etc.

Concretely, the amount of the defoaming agent to be used in the present invention is preferably from 0.001 g to 5 g, more preferably from 0.01 g to 0.5 g, per liter of the liquid in the reactor. Where the amount of the defoaming agent to be used is increased in order to satisfy the scaling-up of the production of photographic emulsions, it may be proportional to the amount of the liquid in the reactor. However, since the time necessary for extinguishing the foams generated shall be prolonged with the increase in the volume of the foams resulting from the scaling-up of the production of photographic emulsions while fixing the rotation number at a predetermined one, the amount of the defoaming agent must be increased by several times or several tens times the enlarged amount of the liquid to be treated in the scaled-up production in order that the defoaming agent added may attain the defoaming performance comparable to that of the agent added to a small amount of the liquid treated on an ordinary small scale.

The time when the polyalkylene oxide group-containing organopolysiloxane (defoaming agent) shall be added to a silver halide emulsion during production of the emulsion is referred to below. The defoaming agent may be added either at the initial stage for forming silver halide grains of the emulsion or during the course of the formation. This may also be added to the emulsion when the emulsion is desalting-washed or when the emulsion is chemically sensitized. If the defoaming agent is added at the initial stage for forming the grains, it is effective to increase the stirring performance of the stirrer used. For instance, when a large amount of a solution of silver nitrate is added at a high speed during the formation of the grains, the reaction system must be stirred at a high speed and it indispensably needs the existence of the defoaming agent therein. Since the emulsion formed is cooled in the step of desalting-washing it, the foams generated during the formation of the grains often exist in the final emulsion to be obtained after the last step. Therefore, it is desirable that the defoaming agent is added to the emulsion being desalting-washed before the emulsion is cooled. The addition of the defoaming agent to the emulsion during the desalting-washing step is effective to shorten the time for sedimenting the silver halide grains formed (or to shorten the time for dispersing the acidic or alkaline sedimenting agent) and to improve the operation for producing silver halide grains (or to easily know the condition of the grains being sedimented). When the desalting-washing of the emulsion formed is automatically conducted after the formation of the emulsion, the foams and flocs floating on the surface of the liquid in the reactor are often problematic in that they soil the surface of the sensor that indicates the condition of the silver halide grains being sedimented. However, if the defoaming agent of the present invention is added to the liquid in the reactor, it removes the foams and flocs with the result that the sensor can indicate an accurate transmittance. In the step of dispersing the emulsion formed, a dispersing medium such as gelatin or the like is added to the emulsion. Therefore, since the emulsion is to have an enlarged gelatin concentration during the dispersing step, it is easily foamed. In this step, therefore, the addition of the defoaming agent of the present invention to the emulsion is effective to remove the foams. The addition of the defoaming agent to the emulsion during chemical sensitization is also effective, since the adsorption of the sensitizing agent, that is added to the surface area of the emulsion, onto the foams existing on the surface area of the emulsion in the absence of the defoaming agent can be prevented with the result that the time necessary for sufficiently dispersing the sensitizing agent in the emulsion can be shortened. In addition, when the defoaming agent is added to the emulsion, the limiting-stirring rotation number of the stirrer used can be increased and therefore the chemicals added to the emulsion can be adsorbed onto the emulsion grains more uniformly within a shortened period of time. Accordingly, it is possible to realize the chemical sensitization of the emulsion with improved reproducibility. The chemical defoaming to be conducted by the use of the defoaming agent can be combined with physical and mechanical defoaming to be conducted by the use of dimples, etc., by which it is possible to further increase the limiting-stirring rotation number of the stirrer without foaming the liquid being stirred therein and it is possible to realize the improvement in the stirring performance of the stirrer.

According to the method of the present invention that uses the defoaming agent mentioned above, the liquid being stirred in a stirrer is prevented from being foamed (i.e., is foam-inhibited) and the foams, even formed, in the liquid can easily be extinguished after the stirring of the liquid is stopped. The advantages of the present invention are shown below.

① The stirring rotation number of the mixer to be used for producing photographic emulsions is increased (that is, the mixing performance of the stirrer is enhanced), and the amount of the liquid (i.e., the delivery rate) to be jetted out from the mixer is increased (that is, the time necessary for circulating the liquid is shortened).

② The bulk mixing time is shortened (that is, the bulk mixing performance is enhanced).

③ The photographic properties due to use of the emulsion to be produced are improved (for example, the fog is lowered and the sensitivity thereof is increased).

④ The critical growth speed of the grains being formed is elevated.

⑤ The monodispersibility of the grains formed is improved.

⑥ The formation of irregular-shaped grains is prevented.

⑦ The foaming of the emulsion during desalting, dispersion and chemical sensitization is prevented.

The silver halide grains to be used in the present invention may be either normal crystals having no twinning plan or twin crystals chosen from the examples explained in Bases in Photographic Industry, Part of Silver Salt Photography (edited by Photographic Society of Japan, published by Corona Co.), page 163, such as mono-layered twin crystals having one twinning plane, parallel multi-layered twin crystals having two or more parallel twinning planes and non-parallel multi-layered twin crystals having two or more nonparallel twinning planes, in accordance with the intended object. As normal crystals, cubic crystals having (100) faces, octahedral crystals having (111) faces, and dodecahedral crystals having (110) faces such as those described in JP-B-55-42737 and JP-A-60-222842 can be used. In addition, also (hll) grains, (hhl) grains, (jkl) grains, etc., such as those described in Journal of Imaging Science, Vol. 30, page 247 (1986) can be used, in accordance with the intended object. Further in the present invention, 14-hedral grains having both (100) and (111) faces and grains having both (111) and (110) faces can be used in accordance with the intended object. If desired, also other various polyhedral grains such as 38-hedral grains (i.e., triaxisoctahedron), biased rhombic 24-hedral grains (i.e., icositetrahedron), 46-hedral grains (i.e., tetraxishexahedron), 68-hedral grains, etc can be used.

The grain size of the silver halide grains to be in the emulsion of the present invention is not specifically defined. The grains may be small grains having a grain size of 0.1 μm or less in terms of the diameter of the projected area of the grain or large grains having a grain size of more than 10 μm or ordinary grains falling between such small grains and large grains. The silver halide emulsion comprising the grains may be either a mono-dispersed emulsion having a narrow grain size distribution or a poly-dispersed emulsion having a broad grain size distribution. However, the present invention is more effective when applied to polydispersed emulsions.

The silver halide photographic emulsion of the present invention may be prepared by known methods, for example, by those described in P. Glafkides, *Chimie et Physique Photoqraphique* (published by Paul Montel Co., 1967), G. F. Duffin, *Photographic Emulsion Chemistry* (published by Focal Press Co., 1966), and V. L. Zelikman et al, *Making and Coating Photographic Emulsion* (published by Focal Press Co., 1964). For instance, they may be prepared by any of an acid method, a neutral method or an ammonia method. As a system of reacting a soluble silver salt and soluble halogen salt(s), any of a single jet method, a double jet method and a combination thereof may be employed. A so-called reverse mixing method may also be employed, in which silver halide grains are formed in an atmosphere of having excess silver ions. As one system of a double jet method, a so-called controlled double jet method in which the silver ion concentration (pAg) in the liquid phase of forming silver halide grains is kept constant may also be employed. In accordance with the method, silver halide grains each having a regular crystalline form and having a nearly uniform grain size can be obtained.

The container containing the polyalkylene oxide group-containing organopolysiloxane of the present invention may apply to various methods for producing silver halide emulsions, such as a single jet method, a double jet method, a controlled double jet method, etc. In particular, the present invention is advantageous when applied to the controlled double jet method in that the limiting non-foaming stirring rotation number of the stirrer used can be increased with the result that the reaction in the stirrer is finished more rapidly and completely than that in the stirrer not containing the defoaming agent. According to the present invention, therefore, it is relatively easy to maintain the silver ion concentration in the dispersion in the mixer at a predetermined value and it is therefore possible to produce uniformly-controlled silver halide grains such as monodispersed silver halide grains. Thus, the present invention is significantly advantageous in producing the intended silver halide photographic emulsions.

In particular, when the present invention is applied to a double jet method or a controlled double jet method where an aqueous solution of a silver salt having a high concentration is reacted with an aqueous solution of a halide also having a high concentration, the limiting non-foaming stirring rotation number of the stirrer used can be increased and the formation of irregular-shaped grains can be prevented. Thus, the present invention is significantly advantageous in producing only the intended silver halide photographic emulsions.

The above-mentioned silver halide emulsions can be obtained by controlling the pAg and pH values in the system of forming the grains. The details of the formation of the regular grains are described in, for example, Photographic Science and Engineering, Vol. 6, pp. 159 to 165 (1962); Journal of Photographic Science, Vol. 12, pp. 242 to 251 (1964); U.S. Pat. No. 3,655,394 and British Patent 1,413, 748.

The halide composition of the silver halide grains to be used in the present invention is not specifically defined but may be any of silver bromide, silver chloride, silver iodide, silver chlorobromoiodide, silver chloroiodide and silver bromoiodide.

When gelatin or the like compound that is subjected to gelation at low temperatures is used in forming the grains, the grains may be formed at a temperature of not lower than the melting point of such a compound but up to about 100° C. in order that the grains are not decomposed by heat.

On the other hand, when a compound that does not gel even at low temperatures is used, the grains may be formed at a temperature falling within a broad range of even from 0° C. or lower at which the aqueous solutions being reacted are not frozen to lower than the boiling point of the aqueous solutions at which the compound used is decomposed. Preferably, however, the grains are formed at a temperature falling within the range between 4° C. and 100° C. The reaction temperature as well as the pH and pAg values in the reaction system can be varied anywhere during the course of the formation of the grains in accordance with the intended object. It is also possible to form the grains by suitably selecting the kind and the amount of the solvent and suitably controlling the flow rates (i.e., the addition speed) and the concentrations of the silver salt and the halides to be reacted.

To form the grains, a silver halide solvent is often used. Examples of the solvent includes, for example, thiocyanates, thioethers, thioureas, etc. Ammonia may be also used in such a degree that it gives no bad influence on the grains formed.

For example, thiocyanates such as those described in U.S. Pat. Nos. 2,222,264, 2,448,534, 3,320,069, thioether compounds such as those described in U.S. Pat. Nos. 3,271,157, 3,574,628, 3,704,130, 4,297,439, 4,276,347, thione compounds such as those described in JP-A-53-144319, JP-A-53-82408, JP-A-55-77737, amine compounds such as those described in JP-A-54-100717, etc. can be used as the solvent.

In the step of forming the silver halide grains or of physically ripening them, salts or complexes of various heavy metals and light metals (including transition metals), such as cadmium salts, zinc salts, lead salts, thallium salts, iridium salts and complexes thereof, rhodium salts and complexes thereof, and iron salts and complexes thereof, can be added.

In order to promote the growth of the silver halide grains being formed, employable are methods of increasing the flow rate (i.e., the addition speed) of the aqueous solution of a silver salt (e.g., aqueous solution of $AgNO_3$) and the aqueous solution of a halide (e.g., aqueous solution of KBr) to be added and increasing the amount and the concentration of the solutions. For these methods, for example, referred to are the disclosures in British Patent 1,335,925, U.S. Pat. Nos. 3,672,900, 3,650,757, 4,242,455, JP-A-55-142329, JP-A-55-158124, JP-A-58-113927, JP-A-58-113928, JP-A-58-111934, JP-A-58-111936.

The silver halide emulsion that has been produced in a reactor in the presence of the polyalkylene oxide group-containing organopolysiloxane according to the present invention and in the manner mentioned hereinabove can be directly desalting-washed by ordinary flocculation still in the reactor. If desired, the emulsion may also be desalted and washed according to other various methods of natural sedimentation, centrifugation, ultrafiltration, isoelectric point coagulation, etc. When the desalting of the emulsion is conducted by flocculation, ordinary sedimenting agents that are generally used for desalting of gelatin-containing emulsion and also the sedimenting agent described in U.S. Pat. No. 3,679,425, JP-A-47-4326 can be used. It is also possible to first add an ampholytic polyelectrolyte and then add the sedimenting agent to the emulsion. To make the silver halide grains precipitated by varying the pH of the emulsion or by adding the sedimenting agent to the emulsion, the charge of the protective colloid used in forming the grains shall be removed, for which the above-mentioned methods are not limitative.

The silver halide emulsion that has been produced in a reactor in the presence of the polyalkylene oxide group-containing organopolysiloxane according to the present invention and in the manner mentioned hereinabove can be directly subjected to chemical sensitization still in the reactor.

As the chemical sensitizer used for the chemical sensitization, first mentioned is a chalcogen sensitizer including a sulfur sensitizer, a selenium sensitizer and a tellurium sensitizer. Various compounds such as those mentioned below are known as these sensitizers. As the sulfur sensitizer, labile sulfur compounds which include various known sulfur compounds such as thiosulfates (e.g., sodium thiosulfate), thioureas (e.g., diphenylthiourea, triethylthiourea, allylthiourea), allyl isothiocyanate, cystine, p-toluenethiosulfonates, rhodanines, mercapto compounds, etc., can be used. The amount of the sulfur sensitizer to be added to the emulsion may be such that it can effectively increase the sensitivity of the emulsion. The effective amount varies, depending on various conditions of the emulsion, such as the pH and the temperature of the emulsion, the other sensitizers added to the emulsion, the size of the silver halide grains in the emulsion, etc. In general, however, the sulfur sensitizer is added to the emulsion in an amount of from $1\times10_{-9}$ to $1\times10_{-1}$ mol per mol of the silver halide in the emulsion.

For the selenium sensitization, usable are known labile selenium compounds including, for example, colloidal selenium metal, selenoureas (e.g., N,N-dimethylselenourea, N,N-diethylselenourea), selenoketones, selenoamides, aliphatic isoselenocyanates (e.g., allyl isoselenocyanate), selenocarboxylic acids, selenocarboxylates, selenophosphates, selenides such as diethylselenides, diethyldiselenides, etc. The amount of the selenium sensitizer to be added to the emulsion varies depending on various conditions of the emulsion, like that of the sulfur sensitizer mentioned above. In general, however, the amount is preferably from $1\times10^{-10}$ to $1\times10^{-1}$ mol per mol of the silver halide in the emulsion.

In addition to the above-mentioned chalcogen sensitization, noble metal sensitization may also be applied to the emulsion of the present invention. For the noble metal sensitization, a gold sensitizer including various gold compounds in which the gold may be either monovalent or trivalent may be used. Specific examples of such the gold compounds, include chloroauric acids, potassium chloroaurate, auric trichloride, potassium aurithiocyanate, potassium iodoaurate, tetraauric acid, ammonium aurothiocyanate, pyridyl chlorogold, gold sulfite, gold selenide, gold telluride, etc.

The amount of the gold sensitizer to be added to the emulsion varies depending on various conditions of the emulsion. In general, however, the amount is preferably from $1\times10^{-10}$ to $1\times10^{-1}$ mol per mol of the silver halide in the emulsion.

The gold sensitization may be conducted simultaneously with the sulfur sensitization, selenium sensitization and/or tellurium sensitization, or may be conducted during, before or after the sulfur sensitization, selenium sensitization and/or tellurium sensitization, or may be conducted singly.

The emulsion to be subjected to the sulfur sensitization, selenium sensitization, tellurium sensitization and/or gold sensitization is not specifically defined in terms of the pAg value and the pH value. Preferably, however, the pAg value of the emulsion falls between 5 and 11 and the pH value thereof falls between 3 and 10.

In addition to the gold sensitizers, other noble metal sensitizers for the noble metal sensitization may be also used. Examples of the noble metal sensitizers except gold sensitizers include salts or complexes of metals such as platinum, palladium, iridium, rhodium, etc.

The emulsion of the present invention may also be subjected to reduction sensitization, by which the formation of uniform silver nuclei that are directly observed by a restrained development is possible. The reduction sensitizers well-known can be used for the sensitization, including, for example, ascorbic acid, stannous salts, amines, polyamines, hydrazine derivatives, formamidinesulfinic acids, silane compounds, borane compounds, etc. For the reduction sensitization, one or more of these compounds can be used. Of these reduction sensitizers, preferred are stannous chloride, thiourea dioxide, dimethylaminoborane, L-ascorbic acid and aminoiminomethanesulfonic acid. The amount of the reduction sensitizer to be added to the emulsion depends on the conditions of the emulsion and therefore can be selected suitably. In general, however, the amount may be from $1\times10^{-9}$ to $1\times10^{-2}$ mol per mol of the silver halide in the emulsion.

In addition to the addition method of the above-mentioned reduction sensitization, the reduction sensitization of the emulsion may also be conducted by a so-called silver ripening method where the silver halide grains are grown or ripened in a low pAg atmosphere having a pAg value of from 1 to 7, or by a method of introducing hydrogen gas into the emulsion, or also by a method of reducing the emulsion with hydrogen in a nascent state that has been generated by electrolysis. The reduction sensitization may be effected by a combination of two or more of these methods.

The reduction sensitization may be applied to the emulsion singly or together with the above-mentioned chalcogen sensitization and/or noble metal sensitization.

The photographic material of the present invention is not specifically defined in terms of the numbers of the silver halide emulsion layers and light-insensitive layers constituting the material as well as the order of the layers on the support. When the material is a color photographic material, it has unit light-sensitive layers comprising a red-sensitive layer, a green-sensitive layer and a blue-sensitive layer as formed on the support in this order. As the case may be, however, the order may be opposite to the above-mentioned one or a different color-sensitive layer may be sandwiched between the same color-sensitive layers, in accordance with the object of the photographic material.

Various light-insensitive layers such as interlayer may be provided between the above-mentioned silver halide light-sensitive layers, or as the uppermost or lowermost layers.

Such an interlayer may contain various couplers and DIR compounds described in JP-A-61-43748, JP-A-59-113438, JP-A-59-113440, JP-A-61-20037 and JP-A-61-20038, and it may also contain conventional color mixing preventing agents.

As the constitution of the plural silver halide emulsions of constituting the respective light-sensitive layer units, preferred is a two-layered constitution composed of a high-speed emulsion layer and a low-sensitivity emulsion layer as described in German Patent 1,121,470 and British Patent 923,045. In general, it is preferred that the plural light-sensitive layers are arranged on the support in such a way that the sensitivity degree of the layer is gradually decreased in the direction to the support. In the embodiment, a light-insensitive layer may be provided between the plural silver halide emulsion layers. As another embodiment, a low-speed emulsion layer is formed remote from the support and a high-speed emulsion layer is formed near to the support, as so described in JP-A-57-112751, JP-A-62-200350, JP-A-62-206541, and JP-A-62-206543.

Specific examples of the layer constitution on the support include an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL) from the remotest side from the support; and an order of BH/BL/GL/GH/RH/RL; and an order of BH/BL/GH/GL/RL/RH.

As other examples, there are mentioned an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and JP-A-62-63936.

As further example, there is mentioned a three-layer unit constitution as described in JP-B-49-15495, where the uppermost layer is a highest-speed silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of the type, the sensitivity degree of each emulsion layer is gradually lowered to the direction of the support. Even in the three-layer constitution of the type, each of the same color-sensitive layers may be composed of three layers of middle-speed emulsion layer/high-speed emulsion layer/low-speed emulsion layer as formed in this order from the remotest side from the support, as so described in JP-A-59-202464.

As still other examples of the layer constitution of the photographic material of the present invention, there are mentioned an order of high-speed emulsion layer/low-speed emulsion layer/middle-speed emulsion layer, and an order of low-speed emulsion layer/middle-speed emulsion layer/high-speed emulsion layer. Where the photographic material of the invention has four or more layers, the layer constitution thereof may be varied in accordance with the manner mentioned above.

In order to improve the color reproducibility, it is desired to provide a doner layer (CL) which has an interlayer effect and which has a different spectral sensitivity distribution from that of the essential light-sensitive layers of BL, GL and RL, adjacent to or near to the essential light-sensitive layers, in the manner as described in U.S. Pat. Nos. 4,663,271, 4,705,744 and 4,707,436 and JP-A-62-160448 and JP-A-63-89850.

As mentioned above, various layer constitutions and arrangements may be selected in accordance with the object of the photographic material.

The photographic material of the present invention may comprise emulsion(s) of light-insensitive, red-fogged fine silver halide grains. Light-insensitive fine silver halide grains mean fine silver halide grains which are not sensitive to the light as imparted to the photographic material upon imagewise exposure to obtain color images and are substantially not developed in the step of development of the exposed material.

The red-fogged, fine silver halide grains have a silver bromide content of from 0 to 100 mol % and, if desired, they may additionally contain silver chloride and/or silver iodide. Preferably, they contain silver iodide in an amount of from 0.5 to 10 mol %. The fine silver halide grains are desired to have a mean grain size (as a mean value of the circle-corresponding diameter of the projected area) of from 0.01 to 0.5 μm, more preferably from 0.02 to 0.2 μm. The fine silver halide grains may be prepared by the same method as that of preparing ordinary light-sensitive silver halide grains. In the case, the surfaces of the fine silver halide grains to be prepared do not need to be chemically sensitized and spectral sensitization of the grains is not needed. However, prior to addition of the fine grains to the coating composition, it is desired to previously add a well-known stabilizer, such as triazole compounds, azaindene compounds, benzothiazolium compounds or, mercapto compound or zinc compounds, to the coating composition. The fine silver halide grains-containing layer may preferably contain colloidal silver.

The amount of silver coated in the photographic material of the present invention is preferably 6.0 g/m$^2$ or less, more preferably 4.5 g/m$^2$ or less.

Various well-known photographic additives which may be used for preparing the photographic material of the present invention are described in the following three Research Disclosures, and the related descriptions therein are shown in the following table.

| Additives | RD 17643 | RD 18716 | RD 307105 |
|---|---|---|---|
| 1 Chemical Sensitizer | page 23 | page 648, right column | page 866 |
| 2 Sensitivity Increasing Agent | | page 648, right column | |
| Spectral Sensitizing Agent | pages 23 to 24 | page 648, right column, to page 649, right column | pages 866 to 868 |
| Supersensitizing Agent | pages 23 to 24 | page 648, right column, to page 649, right column | pages 866 to 868 |
| 4 Brightening Agent | page 24 | | page 868 |
| 5 Anti-foggant | pages 24 to 25 | page 649, right column | pages 868 to 870 |
| Stabilizer | pages 24 to 25 | page 649, right column | pages 868 to 870 |
| 6 Light Absorbent | pages 25 to 26 | page 649, right column to page 650, left column | page 873 |
| Filter Dye | pages 25 to 26 | page 649, right column to page 650, left column | page 873 |
| Ultraviolet Absorbent | pages 25 to 26 | page 649, right column to page 650, left column | page 873 |
| 7 Stain Inhibitor | page 25, right column | page 650, left column to right column | page 872 |
| 8 Color Image Stabilizer | page 25 | page 650, left column | page 872 |
| 9 Hardening Agent | page 26 | page 651, left column | page 874 to 875 |
| 10 Binder | page 26 | page 651, left column | page 873 to 874 |
| 11 Plasticizer, Lubricant | page 27 | page 650, right column | page 876 |
| 12 Coating Aid | pages 26 to 27 | page 650, right column | pages 875 to 876 |
| Surfactant | pages 26 to 27 | page 650, right column | pages 875 to 876 |
| 13 Antistatic Agent | page 27 | page 650, right column | pages 876 to 877 |
| 14 Matting Agent | | | pages 878 to 879 |

In order to prevent deterioration of the photographic property of the photographic material by formaldehyde gas as imparted thereto, compounds capable of reacting with formaldehyde so as to fix it, for example, those described in U.S. Pat. Nos. 4,411,987 and 4,435,503, are preferably incorporated into the photographic material.

It is preferred to incorporate mercapto compounds described in U.S. Pat. Nos. 4,740,454 and 4,788,132 and JP-A-62-18539 and JP-A-1-283551 into the photographic materials of the present invention.

It is also preferred to incorporate, into the photographic materials of the present invention, compounds capable of releasing a foggant, a development accelerator, a silver halide solvent or a precursor thereof, irrespective of the amount of the developed silver as formed by development, which are described in JP-A-1-106052.

It is also preferred to incorporate, into the photographic materials of the present invention, dyes as dispersed by the method described in International Patent (Laid-Open) No. WO88/04794 and Japanese Patent Kohyo Koho Hei-1-502912, or dyes as described in European Patent 317,308A, U.S. Pat. No. 4,420,555 and JP-A-1-259358.

When the photographic material of the present invention is a color photographic material, it may contain various color couplers. Examples of the color couplers are described in patent publications as referred to in the above-mentioned RD No. 17643, VII-C to VII-G, and RD No. 307105, VII-C to VII-G.

As yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred.

As magenta couplers, 5-pyrazolone compounds and pyrazoloazole compounds are preferred. For instance, those described in U.S. Pat. Nos. 4,310,619, 4,351,897, European Patent 73,636, U.S. Pat. Nos. 3,061,432, 3,725,045, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and International Patent (Laid-Open) No. WO88/04795 are especially preferably used in the present invention.

As cyan couplers, phenol couplers and naphthol couplers can be used. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, German Patent (OLS) 3,329,729, European Patents 121,365A, 249,453A, U.S. Pat. Nos. 3,446,622, 4,333,999, 4,775,616, 4,451,559, 4,427,767, 4,690,889, 4,254,212, 4,296,199, and JP-A-61-42648. In addition, pyrazoloazole couplers described in JP-A-64-553, JP-A-64-554, JP-A-64-555 and JP-A-64-556 and imidazole couplers described in U.S. Pat. No. 4,818,672 can be also used.

Polymerized dye-forming couplers may also be used, and typical examples of such the couplers are described in U.S. Pat. Nos. 3,451,820, 4,080,211, 4,367,282, 4,409,320, 4,576,910, British Patent 2,102,137 and European Patent 341,188A.

Couplers capable of forming a colored dyes having a pertinent diffusibility may also be used, and those described in U.S. Pat. No. 4,366,237, British Patent 2,125,570, European Patent 96,570, and German Patent (OLS) No. 3,234,533 are preferred as the coupler used.

As colored couplers for correcting the unnecessary absorption of colored dyes, those described in RD No. 17643, VII-G, RD No. 307105, VII-G, U.S. Pat. No. 4,163,670, JP-B-57-39413, U.S. Pat. Nos. 4,004,929, 4,138,258, and British Patent 1,146,368 are preferred. Additionally, couplers of correcting the unnecessary absorption of the colored dye by the fluorescent dye to be released during coupling, as described in U.S. Pat. No. 4,774,181, as well as couplers having a dye precursor group capable of reacting with a developing agent to form dyes, as a releasing group, as described in U.S. Pat. No. 4,777,120 are also preferably used.

Couplers capable of releasing a photographically useful residue along with coupling may also be used in the present invention. For instance, as DIR couplers capable of releasing a development inhibitor, those described in the above-mentioned RD No. 17643, Item VII-F, RD No. 307105, Item VII-F, as well as those described in JP-A-57-151944, JP-A-57-154234, JP-A-60-184248, JP-A-63-37346 and JP-A-63-37350 and U.S. Pat. Nos. 4,248,962 4,782,012 are preferred.

Couplers capable of releasing a bleaching accelerator, as described in RD Nos. 11449 and 24241 and JP-A-61-201247, are effective for shortening the time for the processing step with a processing solution having a bleaching capacity, and the effect is especially noticeable when they are added to the photographic material of the present invention containing the above-mentioned tabular silver halide grains.

As couplers capable of imagewise releasing a nucleating agent or development accelerator during development, those described in British Patents 2,097,140 and 2,131,188, and JP-A-59-157638 and JP-A-59-170840 are preferred as the coupler. In addition, compounds capable of releasing a foggant, a development accelerator or a silver halide solvent by redox reaction with an oxidant of a developing agent, as described in JP-A-60-107029, JP-A-60-252340, JP-A-1-44940 and JP-A-1-45687, are also preferably used.

Additionally, as examples of compounds which may be incorporated into the photographic materials of the present invention, there are further mentioned competing couplers described in U.S. Pat. No. 4,130,427; poly-valent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers capable of releasing a dye which color-restores after released from the coupler, as described in European Patents 173,302A and 313,308A; ligand-releasing couplers described in U.S. Pat. No. 4,553,477; leuco dye-releasing couplers described in JP-A-63-75747; and couplers of releasing a fluorescent dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents which can be used in the method are described in U.S. Pat. No. 2,322,027. Examples of high boiling point organic solvents having a boiling point of 175° C. or higher at normal pressure, which are used in an oil-in-water dispersion method include phthalates (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl-p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tertamylphenol), aliphatic carboxylates (e.g., bis(2-ethylhexyl)sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately from 30° to 160° C., preferably from 50° to 160° C. can be used. Examples of such the auxiliary organic solvents include ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of the dispersion method, the effect of the method and examples of latexes used in the method for impregnation are described in U.S. Pat. No. 4,199,363, German Patent (OLS) Nos. 2,541,174 and 2,541,130.

The color photographic material of the present invention preferably contains an antiseptic or fungicide of various kinds, for example, selected from phenethyl alcohol and those described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

Suitable supports which can be used in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers as provided on the surface of the support having emulsion layers is preferably 28 microns or less, more preferably 23 microns or less, further more preferably 18 microns or less, especially preferably 16 microns or less, in the photographic material of the present invention. It is also preferred that the photographic material of the invention has a film swelling rate (T ½) of preferably 30 seconds or less, more preferably 20 seconds or less. The film thickness as referred to herein is one as measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., *Photographic Science Engineering*, Vol. 19, No. 2, pages 124 to 129. The film swelling rate (T ½) is defined as follows: 90% of the maximum swollen thickness of the photographic material as processed in a color developer under the condition of 30° C. and 3 minutes and 15 seconds is called a saturated swollen thickness. The time necessary for attaining a half (½) of the saturated swollen thickness is defined to be a film swelling rate (T ½).

The film swelling rate (T ½) can be adjusted by adding a hardening agent to gelatin of a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness—original (dry) film thickness)/(original (dry) film thickness).

It is preferred that the photographic material of the present invention has a hydrophilic colloid layer having a total dry thickness of from 2 μm to 20 μm on the side opposite to the side of having the emulsion layers. The layer is referred to as a backing layer. It is preferred that the backing layer contains various additives of the above-mentioned light absorbent, filter dye, ultraviolet absorbent, antistatic agent, hardening agent, binder, plasticizer, swelling agent, coating aid and surfactant. The backing layer is desired to have a swelling degree of from 150 to 500%.

EXAMPLE

The present invention is described in more detail by means of the following examples, which, however, are not intended to restrict the scope of the present invention.

Pururonic TM31R1 (product of BASF) employed hereinunder as a comparative sample has the following structure:

$$HO—(OC_3H_6)_{25.2}(OC_2H_4)_{7.4}(C_3H_6O))_{25.2}—H$$

In the following examples, used were modified silicones S-7 and S-15 as the samples of the defoaming agent of the present invention.

In the examples, a pre-determined amount of the defoaming agent was previously added to the reaction system before starting the stirring of the system.

Example 1

This is to obtain the increase, if any, in the volume of a solution of gelatin after the solution was stirred in a stirrer at a high speed (Part 1). This is also to obtain the limiting rotation number of the stirrer, at which the solution was stirred without being foamed.

A gelatin solution (pH 5.5) containing 21 g of deionized gelatin in 700 ml of water was prepared and put into a reaction vessel with a stirrer.

The solution was kept at 50° C. and stirred at a stirring rotation number of 1400 rpm for 30 minutes, and thereafter the volume of the foams formed in the gelatin solution was measured.

Using various defoaming agents shown in Table 1 below, the volume of the foams was measured immediately after having stopped the stirring. The results are shown in Table 1. In addition, the limiting rotation number of the stirrer at which the solution was stirred without being foamed was measured. The results are shown in Table 2 below.

The defoaming agent was dissolved in a mixed solvent of water/methanol of 1/1 at a concentration of 1 wt %, and 6 ml of the resulting solution (containing 0.06 g of the defoaming agent) were added to the gelatin solution.

TABLE 1

Volume of Foams in Gelatin Solution at 1400 rpm (amount of solution: 700 ml)

| | Defoaming Agent | Volume of Foams (ml) |
|---|---|---|
| Comparative Example | None | 700 |
| Comparative Example | Pururonic TM31R1 (product of BASF) | 100 |
| Example of the Invention | Modified Silicone (S-15) | 0 |
| Example of the Invention | Modified Silicone (S-7) | 0 |

TABLE 2

Limiting Rotation Number of Stirrer, at which gelatin solution was not foamed (amount of solution: 700 ml)

| | Defoaming Agent | Limiting Rotation Number (rpm) |
|---|---|---|
| Comparative Example | None | 500 |
| Comparative Example | Pururonic TM31R1 (product of BASF) | 1200 |
| Example of the Invention | Modified Silicone (S-15) | 1450 |
| Example of the Invention | Modified Silicone (S-7) | 1600 |

Example 2

This is to obtain the increase, if any, in the volume of a solution of gelatin after the solution was stirred in a stirrer at a high speed (Part 2).

A gelatin solution (pH 5.5) containing 360 g of deionized gelatin in 12 liters of water was prepared and put into a reaction vessel with a stirrer.

The solution was kept at 50° C. and stirred at a stirring rotation number of 1100 rpm for 9 minutes, and thereafter the volume of the foams formed in the gelatin solution was measured.

The defoaming agent was dissolved in a mixed solvent of water/methanol of 1/1 at a concentration of 10 wt %, and 7.2 ml of the resulting solution (containing 0.72 g of the defoaming agent) were added to the gelatin solution.

TABLE 3

Volume of Foams in Gelatin Solution at 1100 rpm (amount of solution: 12 liters)

| | Defoaming Agent | Volume of Foams (ml) |
|---|---|---|
| Comparative Example | None | 4500 |
| Comparative Example | Pururonic TM31R1 | 1200 |

TABLE 3-continued

| Volume of Foams in Gelatin Solution at 1100 rpm (amount of solution: 12 liters) | | |
|---|---|---|
| | Defoaming Agent | Volume of Foams (ml) |
| | (product of BASF) | |
| Example of the Invention | Modified Silicone (S-15) | 800 |
| Example of the Invention | Modified Silicone (S-7) | 600 |

Example 3

This is to obtain the increase, if any, in the volume of a solution of gelatin after the solution was stirred in a stirrer at a high speed (Part 3).

A gelatin solution (pH 5.5) containing 18 kg of deionized gelatin in 600 liters of water was prepared and put into a reaction vessel with a stirrer.

The solution was kept at 50° C. and stirred at a stirring rotation number of 560 rpm for 5 minutes, and thereafter the volume of the foams formed in the gelatin solution was measured.

The defoaming agent was dissolved in a mixed solvent of water/methanol of 1/1 at a concentration of 10 wt %, and 360 ml of the resulting solution (containing 36 g of the defoaming agent) were added to the gelatin solution.

TABLE 4

| Volume of Foams in Gelatin Solution at 560 rpm (amount of solution: 600 liters) | | |
|---|---|---|
| | Defoaming Agent | Volume of Foams (liters) |
| Comparative Example | None | 210 |
| Comparative Example | Pururonic TM31R1 (product of BASF) | 72 |
| Example of the Invention | Modified Silicone (S-15) | 40 |
| Example of the Invention | Modified Silicone (S-7) | 30 |

Example 4

This is to obtain the increase, if any, in the volume of an emulsion after the solution was stirred in a stirrer at a high speed (Part 4).

Various emulsions of silver chloride grains, octahedral silver bromide grains, cubic silver bromide grains and silver iodobromide grains (having an iodide content of 10 mol %), each containing 200 g of silver nitrate and having a gelatin concentration of 3 wt % and pH of 5.5, in which the grain size of the grains was 0.2 μm, were separately put into reaction vessels with a stirrer.

The solutions each were kept at 50° C. and stirred at a stirring rotation number of 1100 rpm for 9 minutes, and thereafter the volume of the foams formed in each emulsion was measured. The same stirring test was conducted for these emulsions at pH of 2.8.

The defoaming agent was dissolved in a mixed solvent of water/methanol of 1/1 at a concentration of 10 wt %, and 367.2 ml of the resulting solution (containing 0.72 g of the defoaming agent) were added to the emulsions.

TABLE 5

| Volume of Foams in Emulsions (pH 5.5) | | | |
|---|---|---|---|
| | Defoaming Agent | Emulsion | Volume of Foams (ml) |
| Comparative Example | None | Octahedral AgBr Grains | 5200 |
| Comparative Example | Pururonic TM31R1 (product of BASF) | $AgBr_{0.9}I_{0.1}$ | 4200 |
| Comparative Example | Pururonic TM31R1 (product of BASF) | Cubic AgBr | 3000 |
| Comparative Example | Pururonic TM31R1 (product of BASF) | Octahedral AgBr | 1800 |
| Comparative Example | Pururonic TM31R1 (product of BASF) | AgCl | 1400 |
| Example of the Invention | Modified Silicone (S-15) | $AgBr_{0.9}I_{0.1}$ | 1500 |
| Example of the Invention | Modified Silicone (S-15) | Cubic AgBr | 1400 |
| Example of the Invention | Modified Silicone (S-15) | Octahedral AgBr | 1300 |
| Example of the Invention | Modified Silicone (S-15) | AgCl | 1050 |
| Example of the Invention | Modified Silicone (S-7) | $AgBr_{0.9}I_{0.1}$ | 1400 |
| Example of the Invention | Modified Silicone (S-7) | Cubic AgBr | 1300 |
| Example of the Invention | Modified Silicone (S-7) | Octahedral AgBr | 1200 |
| Example of the Invention | Modified Silicone (S-7) | AgCl | 1000 |

TABLE 6

| Volume of Foams in Emulsions (pH 2.8) | | | |
|---|---|---|---|
| | Defoaming Agent | Emulsion | Volume of Foams (ml) |
| Comparative Example | None | Octahedral AgBr Grains | 5200 |
| Comparative Example | Pururonic TM31R1 (product of BASF) | $AgBr_{0.9}I_{0.1}$ | 4800 |
| Comparative Example | Pururonic TM31R1 (product of BASF) | Cubic AgBr | 4500 |
| Comparative Example | Pururonic TM31R1 (product of BASF) | Octahedral AgBr | 3600 |
| Comparative Example | Pururonic TM31R1 (product of BASF) | AgCl | 3200 |
| Example of the Invention | Modified Silicone (S-15) | $AgBr_{0.9}I_{0.1}$ | 2700 |
| Example of the Invention | Modified Silicone (S-15) | Cubic AgBr | 2500 |
| Example of the Invention | Modified Silicone (S-15) | Octahedral AgBr | 2300 |
| Example of the Invention | Modified Silicone (S-15) | AgCl | 2100 |
| Example of the Invention | Modified Silicone (S-7) | $AgBr_{0.9}I_{0.1}$ | 2400 |
| Example of the Invention | Modified Silicone (S-7) | Cubic AgBr | 2200 |
| Example of the Invention | Modified Silicone (S-7) | Octahedral AgBr | 2100 |
| Example of the Invention | Modified Silicone (S-7) | AgCl | 1900 |

Example 5

This is to demonstrate the shortening of the bulk mixing time in the presence of a defoaming agent.

A solution of silver nitrate (1 mol/liter) was pulse-wise added to a stirrer at a flow rate of 500 ml/min for 2 seconds, and the time needed until the plural microelectrodes provided in the bulk came to have the same potential was measured at the limiting rotation number of the stirrer under the same condition as that in Example 1. The time measured is referred to as the bulk mixing time. The bulk mixing time varied depending on the defoaming agent added were measured. The results are shown in Table 7.

TABLE 7

Shortening of Bulk Mixing Time in the Presence of Defoaming Agent

| | Defoaming Agent | Rotation Number (rpm) | Variation in Mixing Time (*) (sec) |
|---|---|---|---|
| Comparative Example | None | 500 | — |
| Comparative Example | Pururonic TM31R1 (product of BASF) | 1200 | −2.0 |
| Example of the Invention | Modified Silicone (S-15) | 1450 | −2.3 |
| Example of the Invention | Modified Silicone (S-15) | 1600 | −2.5 |

(*) This indicates the variation in the bulk mixing time relative to the case containing no defoaming agent. The "minus" value means the decrease in the mixing time.

Example 6

This is to demonstrate the increase in the critical growth speed of silver halide grains in the presence of a defoaming agent.

Silver nitrate (1 mol/liter) and potassium bromide (1 mol/liter) were added to octahedral seed crystals of AgBr having a grain size of 0.2 μm and stirred at 50° C. and 50 mV (vs SCE) and at the limiting rotation number in the presence of a defoaming agent, while the flow rates of the silver salt and the halide were varied. The variation in the critical growth speed of the silver halide grains was measured and shown in Table 8 below.

TABLE 8

Increase in Critical Growth Speed of Silver Halide Grains in the Presence of Defoaming Agent

| | Defoaming Agent | Rotation Number (rpm) | Variation in Growth Speed (*) (A/s) |
|---|---|---|---|
| Comparative Example | None | 500 | — |
| Comparative Example | Pururonic TM31R1 (product of BASF) | 1200 | +0.20 |
| Example of the Invention | Modified Silicone (S-15) | 1450 | +0.25 |
| Example of the Invention | Modified Silicone (S-15) | 1600 | +0.30 |

(*) This indicates the variation in the growth speed of the silver halide grains relative to the case containing no defoaming agent.

As is apparent from the results in Examples 5 and 6 above, the addition of the defoaming agent resulted in various advantages in that the limiting rotation number of the stirrer was increased and uniform grains were formed at such an increased rotation number, that the bulk mixing performance was increased (that is, the mixing time was shortened) and that the critical growth speed of the silver halide grains was elevated.

Example 7

This is to demonstrate the decrease (i.e., narrowness) in the grain size distribution of silver halide grains formed in the presence of a defoaming agent.

870 ml of water, 36 g of deionized gelatin and 25 ml of a solution of 1 wt % KBr were put into a reactor and kept at 75° C. A solution of silver nitrate (0.05 mols/liter) and a solution of potassium bromide (0.05 mols/liter) were added thereto for 17 minutes in the first stage and then a solution of silver nitrate (0.82 mols/liter) and a solution of potassium bromide (0.82 mols/liter) were added thereto for 100 minutes in the second stage, both at accelerated flow rates. The silver potential of the reaction system was kept at about +40 mV (vs SCE) in the first stage and was at +100 mV in the second stage.

According to this process, cubic AgBr grains having a mean grain size of 0.8 μm were grown while stirring the reaction system at the limiting rotation number. The change in the variation coefficient which indicates the grain size distribution of the thus-grown grains was obtained and shown in Table 9 below. The variation coefficient is defined by the following equation:

Variation Coefficient = [(standard deviation of grain sizes)/(mean grain size)] × 100 (%)

TABLE 9

Change in Variation Coefficient of Silver Halide Grains in the Presence of Defoaming Agent

| | Defoaming Agent | Rotation Number (rpm) | Change in Variation Coefficient (*) (%) |
|---|---|---|---|
| Comparative Example | None | 500 | — |
| Comparative Example | Pururonic TM31R1 (product of BASF) | 1200 | −2.0 |
| Example of the Invention | Modified Silicone (S-15) | 1450 | −2.3 |
| Example of the Invention | Modified Silicone (S-15) | 1600 | −2.5 |

(*) This indicates the change in the variation coefficient of the silver halide grains, relative to the case containing no defoaming agent. The "minus" value means the decrease in the variation coefficient.

As is apparent from these results, the addition of the defoaming agent to the stirrer resulted in the increase in the stirring performance of the stirrer with which silver halide emulsions having a narrowed grain size distribution were obtained.

Example 8

This is to demonstrate the improvement in the photographic properties of photographic material prepared from photographic emulsions produced in the presence of a defoaming agent (Part 1).

The emulsion comprising cubic AgBr grains having a mean grain size of 0.8 μm, that had been obtained according to the process in Example 6, was de-salted, and gelatin and water were added to the emulsion which was thus adjusted to have pH of 6.5 and pAg of 8.3 at 50° C. The amount of the emulsion was 1100 ml.

The non-chemical sensitized emulsion was subjected to gold and sulfur sensitization in the presence of sodium thiosulfate and chloroauric acid at 60° C., while being sampled in 15 minutes, 30 minutes and 60 minutes. A coating aid and a hardening agent were added to these emulsions, which were then separately coated on cellulose triacetate bases. The thus-coated films were exposed, using a tungsten lamp (having a color temperature of 2854° K.)

through a color filter (BPN-42) and an optical wedge for 1/10 seconds. The thus-exposed films were developed with a surface developer (D-19) having the composition shown below at 20° C. for 5 minutes. The surface photographic properties of the thus-processed films were evaluated. The same films were bleached with red prussiate of potash for 5 minutes, rinsed in water for minutes and then developed with an internal developer (D-19) having the composition shown below and containing KI (0.5 g/liter) at 20° C. for 15 minutes. The internal photographic properties of the thus-processed films were evaluated.

| Surface Developer: | |
|---|---|
| Metol | 2.2 g |
| SS | 96.0 g |
| Hydroquinone | 8.8 g |
| SC (monohydrate) | 56.0 g |
| KBr | 5.0 g |
| Water to make | 1000 ml |
| Internal Developer: | |
| Metol | 2.2 g |
| SS | 96.0 g |
| Hydroquinone | 8.8 g |
| SC (monohydrate) | 56.0 g |
| KBr | 5.0 g |
| KI | 0.5 g |
| Water to make | 1000 ml |

The fog and the sensitivity of the emulsion that had been sensitized by the gold and sulfur sensitization were measured and shown in Table 10 below.

As is apparent from the results in Table 10, it is known that the addition of the defoaming agent to the reactor resulted in various advantages in that the limiting rotation number of the stirrer was increased, that the stirring performance of the stirrer was improved, that the excess silver ions in the reaction system were decreased and that the silver halide emulsion produced and sensitized by gold and sulfur sensitization had a high sensitivity with lowered fog.

TABLE 10

Improvement in Photographic Properties of Photographic Materials Prepared from Photographic Emulsions Produced in the Presence of Defoaming Agent

| | Defoaming Agent | Fog | Sensitivity (*) |
|---|---|---|---|
| Comparative Example | None | 0.15 | 100 |
| Comparative Example | Pururonic TM31R1 (product of BASF) | 0.10 | 110 |
| Example of the Invention | Modified Silicone (S-15) | 0.08 | 110 |
| Example of the Invention | Modified Silicone (S-15) | 0.08 | 110 |

(*) The sensitivity is represented by the reciprocal of the amount of exposure that gave a density of 0.1. The larger is the value indicated, the higher is the sensitivity. The value indicated is a relative sensitivity based on the sensitivity (100) of the emulsion produced in the presence of no defoaming agent.

Example 9

This is to demonstrate the improvement in the photographic properties of photographic material prepared from photographic emulsions produced in the presence of a defoaming agent (Part 2).

25 g of deionized gelatin and 45 ml of a solution of 10 wt. % NaCl were added to 800 ml of deionized water in a reactor and kept at 70° C. A solution of silver nitrate (0.17 mols/liter) and a solution of sodium chloride (0.2 mols/liter) were added thereto for 40 minutes in the first stage and then a solution of silver nitrate (2.2 mols/liter) and a solution of sodium chloride (2.2 mols/liter) were added thereto for 80 minutes in the second stage, both at constant flow rates. The silver potential of the reaction system was kept at from +85 to 95 mV (vs SCE) through the both stages.

The thus-produced emulsion comprising cubic AgCl grains having a mean grain size of 0.8 μm was de-salted, and gelatin and water were added to the emulsion which was thus adjusted to have pH of 6.5 and pAg of 8.3 at 50° C. The amount of the emulsion was about 900 ml. Next, a coating aid and a hardening agent were added to the emulsion, which was then coated on a cellulose triacetate base. The thus-coated film was exposed, using a tungsten lamp (having a color temperature of 2854° K.) through an optical wedge for 1 second. The thus-exposed film was developed with a surface developer (MAA-1) having the composition shown below at 20° C. for 5 minutes.

| Surface Developer: | |
|---|---|
| Metol | 2.5 g |
| α-ascorbic acid | 10.0 g |
| Sodium chloride | 1.0 g |
| Kodalc (product of Eastman Kodak) | 35.0 g |
| Water to make | 1000 ml |

On the other hand, to evaluate the internal photographic properties of the film, the film was bleached with red prussiate of potash for 5 minutes, rinsed in water for 10 minutes and then developed with an internal developer (D-19) having the composition shown below and containing KI (0.5 g/liter) at 20° C. for 5 minutes.

The surface and internal photographic properties of the thus-processed films were evaluated and shown in Table 11 below.

| Internal Developer: | |
|---|---|
| Metol | 2.2 g |
| SS | 96.0 g |
| Hydroquinone | 8.8 g |
| SC (monohydrate) | 56.0 g |
| NaCl | 5.0 g |
| KI | 0.5 g |
| Water to make | 1000 ml |

TABLE 11

Improvement in Photographic Properties of Photographic Material Prepared from Photographic Emulsions Produced in the Presence of Defoaming Agent

| | Defoaming Agent | Fog | Sensitivity (*) |
|---|---|---|---|
| Comparative Example | None | 0.22 | 100 |
| Comparative Example | Pururonic TM31R1 (product of BASF) | 0.18 | 120 |
| Example of the Invention | Modified Silicone (S-15) | 0.16 | 135 |
| Example of the Invention | Modified Silicone (S-15) | 0.16 | 130 |

The sensitivity is represented by the reciprocal of the amount of exposure that gave a density of 0.1. The larger is the value indicated, the higher is the sensitivity. The value indicated is a relative sensitivity based on the sensitivity (100) of the emulsion produced in the presence of no defoaming agent.

According to the present invention that has been described in detail hereinabove, a polyalkylene oxide group-containing organopolysiloxane is added to the silver halide photographic emulsion being produced and the addition of the organopolysiloxane has produced the following fruits:

(1) The stirring rotation number of the stirrer to be used for producing photographic emulsions can be increased while preventing the reaction liquid in the stirrer from being foamed. Therefore, the bulk mixing time for the stirrer can be shortened and the mixing performance of the stirrer can be enhanced significantly.

(2) The conditions for forming silver halide grains can be controlled more uniformly. Therefore, it is easy to produce silver halide grains having a narrowed grain size distribution, and the photographic material prepared from the emulsion containing the thus-produced grains has much improved photographic properties.

(3) The stirring rotation number of the stirrer to be used for producing photographic emulsions can be increased, while preventing the reaction liquid in the stirrer from being foamed and almost not depending on the halide composition and the crystal habit of the silver halide grains to be produced. Thus, the freedom to select the stirring conditions for producing photographic emulsions is enlarged, and it is easy to scale up the production of photographic grains.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereof at least one light-sensitive silver halide emulsion layer, wherein the silver halide emulsion is produce in the presence of a polyalkylene oxide group-containing organopolysiloxane, wherein the polyalkylene oxide group has at least four repeating units.

2. The silver halide photographic material as claimed in claim 1, wherein the polyalkylene oxide group-containing organopolysiloxane is a linear polysiloxane having at least one polyalkylene oxide group-containing siloxane unit represented by formula (I) or (II):

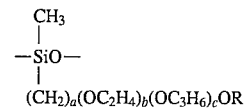

$$-\underset{(CH_2)_a(OC_2H_4)_b(OC_3H_6)_cOR}{\overset{CH_3}{\overset{|}{\underset{|}{Si}}}}O- \quad \text{(I)}$$

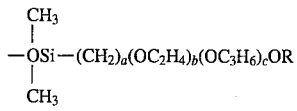

$$-\underset{CH_3}{\overset{CH_3}{\overset{|}{\underset{|}{O}}}}Si-(CH_2)_a(OC_2H_4)_b(OC_3H_6)_cOR \quad \text{(II)}$$

wherein R represents a hydrogen atom or a monovalent group selected from the group consisting of an alkyl group and a phenyl group; a represents from 2 to 12; b and c each represent a number of from 1 to 50, provided that both b and c must not be 0 (zero) at the same time.

3. A silver halide photographic material comprising a support having thereon at least one light-sensitive silver halide emulsion layer, wherein the silver halide emulsion layer is produced in the presence of a foam inhibiting polyalkylene oxide group-containing organopolysiloxane, wherein the polyalkylene oxide group has at least four repeating units.

* * * * *